US009635886B2

(12) United States Patent
Tu

(10) Patent No.: US 9,635,886 B2
(45) Date of Patent: May 2, 2017

(54) ELECTRONIC CIGARETTE WITH THERMAL FLOW SENSOR BASED CONTROLLER

(71) Applicant: Xiang Zheng Tu, San Jose, CA (US)

(72) Inventor: Xiang Zheng Tu, San Jose, CA (US)

(73) Assignee: POSIFA MICROSYSTEMS, INC., San Jose, CA (US)

( * ) Notice: Subject to any disclaimer, the term of this patent is extended or adjusted under 35 U.S.C. 154(b) by 478 days.

(21) Appl. No.: 14/136,382

(22) Filed: Dec. 20, 2013

(65) Prior Publication Data

US 2015/0173419 A1 Jun. 25, 2015

(51) Int. Cl.
*A24F 47/00* (2006.01)

(52) U.S. Cl.
CPC ..... *A24F 47/008* (2013.01)

(58) Field of Classification Search
USPC ..... 131/329, 330, 347, 360
See application file for complete search history.

(56) References Cited

U.S. PATENT DOCUMENTS 5,060,671 A 10/1991 Counts et al.
5,591,368 A 1/1997 Fleischhauer et al.
5,750,964 A 5/1998 Counts et al.
5,988,176 A 11/1999 Baggett, Jr. et al.
6,026,820 A 2/2000 Baggett, Jr. et al.
6,040,560 A 3/2000 Fleischhauer et al.
2006/0196518 A1* 9/2006 Hon ..... A24F 47/002 131/360
2008/0257367 A1* 10/2008 Paterno ..... A24F 47/008 131/328
2014/0345635 A1* 11/2014 Rabinowitz ..... A24B 15/16 131/352

OTHER PUBLICATIONS

Verhoeven et al, "An integrated gas flow sensor with high sensitivity, low response time and a pulse-rate output", Sensors and Actuators A, v. 41-42, (1994), pp. 217-220.*

* cited by examiner

*Primary Examiner* — Dennis Cordray
(74) *Attorney, Agent, or Firm* — James M. Wu; JW Law Group

(57) ABSTRACT

An electronic cigarette with a thermal flow sensor based controller is provided which comprises a housing; a battery, a controller assembly; an air inlet for allowing air to enter into the housing, a mouthpiece; a fluid reservoir; an atomizer; at least a light emitting diode; and a display. The thermal flow sensor is fabricated using micro-electro-mechanical systems (MEMS) technologies which is amenable to create the electronic cigarette with a thermal flow sensor based controller having stable evaporated liquid delivering, immediately response to smoker inhalation, like normal cigarette inhalation resistance, low power consumption, and no accidental actuation take place.

20 Claims, 5 Drawing Sheets

ELECTRONIC CIGARETTE WITH THERMAL FLOW SENSOR BASED CONTROLLER

FIELD

The exemplary embodiment of the present invention relates to electronic cigarettes. More specifically, the exemplary embodiment(s) of the present invention relates to an electronic cigarette with a thermal flow sensor based controller.

BACKGROUND

Electronic cigarette emits doses of vaporized nicotine that are inhaled. It has been said to be an alternative for tobacco smokers who want to avoid inhaling smoke.

Tobacco smoke contains over 4,000 different chemicals, many of which are hazardous for human health. Death directly related to the use of tobacco is estimated to be at least 5 million people annually. If every tobacco user smoked one pack a day, there would be a total of 1.3 billion packs of cigarettes smoked each day, emitting a large amount of harmful tar, CO and other more than 400gas contents to homes and offices, causing significant second-hand smoking damages to human health.

In order to overcome these problems, people have invented many new technologies and products, such as nicotine patches, nicotine gum, etc. Recently, several new inventions have been made, including the following U.S. Pat. Nos. 5,060,671; 5,591,368; 5,750,964; 5,988,176; 6,026,820 and 6,040,560 disclose electrical electronic cigarettes and methods for manufacturing an electronic cigarette, which patents are incorporated here by reference.

The electronic cigarettes currently are available on the market. Most electronic cigarettes take an overall cylindrical shape although a wide array of shapes can be found; box, pipe styles etc. Most are made to look like the common tobacco cigarette. Common components include a liquid delivery and container system, an atomizer, and a power source. Many electronic cigarettes are composed of streamlined replaceable parts, while disposable devices combine all components into a single part that is discarded when its liquid is depleted.

These cigarette substitutes cannot satisfy habitual smoking actions of a smoker, such as an immediacy response, a desired level of delivery, together with a desired resistance to draw and consistency from puff to puff and from cigarette to cigarette. It is desirable for an electronic cigarette to deliver smoke in a manner that meets the smoker experiences with more traditional cigarettes so that it can be widely accepted as effective substitutes for quitting smoking.

SUMMARY

An objective of the present invention is to provide a thermal flow sensor based electronic cigarette that overcomes the above-mentioned disadvantages and provides a cigarette that looks like a normal cigarette and smokes like a normal cigarette. The thermal flow sensor based controller comprises a housing; a battery, a controller assembly consisting of a thermal flow sensor and an application-specific integrated circuit (ASIC) which is disposed in the housing and connected with the battery and the thermal flow sensor electrically; an air inlet for allowing air to enter into the housing, a mouthpiece for allowing user to suck on the housing; a fluid reservoir; an atomizer consisting of a coil heater, wherein the coil heater is arranged on the outside of an atomizer; at least a light emitting diode; and a display.

The thermal flow sensor is fabricated using Micro-Electro-Mechanical Systems (MEMS) technologies.

In a first embodiment the thermal flow sensor composes of a resistive heater and a thermopile, wherein the thermocouples of the thermopile are perpendicular to the resistive heater and the hot contacts of the thermopile and the resistive heater lie on a stack layer consisting of a porous silicon layer and an empty gap, which recessed in a silicon substrate and provides local thermal isolation from the silicon substrate and the cold contacts of the thermopile lie on the bulk portion of the silicon substrate.

In a second embodiment the thermal flow sensor composes of two parallel resistive heaters and two thermopiles, wherein the thermopiles dispose on two opposite sides of the resistive heaters respectively and the thermocouples of the two thermopiles are perpendicular to the resistive heaters and the hot contacts of the thermopiles and the resistive heaters lie on a stack layer consisting of a porous silicon layer and an empty gap, which are recessed in a silicon substrate and provides local thermal isolation from the silicon substrate and the cold contacts of the thermopiles lie on the bulk portion of the silicon substrate.

The thermal flow sensor is installed in the housing with its longitudinal direction perpendicular to the resistive heater(s) so that when there is no air flow through the housing, the temperature profile around the resistive heater(s) is symmetric and when an air flow is produced by a smoker inhalation, the temperature profile will shift from the up flow direction to the down flow direction, which represents the temperature change coursed by the air flow and can be detected by the thermopile(s) of the sensor so that an electrical signal is generated which represents the rate of the air flow.

An advantage of the present invention is that the thermal flow sensor based controller is able immediately to respond to the air flow caused by a smoker inhalation or is able to respond in about 5 ms to the air flow caused by a smoker inhalation.

Another advantage of the present invention is that the thermal flow sensor based controller can be operated in pulse heating mode in which the power consumption can be as low as in the range of 0.01 to 10 mw in which the low power consumption can be used in sleep mode and the high power consumption can be used in normal working mode.

Another advantage of the present invention is that the thermal flow sensor based controller has high dynamic range and can measure air volume flow rate from 0.01 to 100 liter/min so that the airway for air flow caused by a smoker inhalation can be configured without any constriction to provide a flow resistance which imitates an air flow of a tobacco cigarette.

Still another advantage of the present invention is that the thermal flow sensor based controller can be configured to: receive the output voltage representing the air flow rate from the amplifier which is produced by a smoker inhalation, determine a heating current that is used to heat the coil heater of the atomizer, and deliver an amount of the fluid vapor generated by the heating the coil heater of the atomizer which is wanted by the smoker regardless of a hard inhalation or a weak inhalation and a longer inhalation or a short inhalation.

Still another advantage of the present invention is that the thermal flow sensor based controller can be configured to: receive the output voltage representing the air flow rate from the amplifier which is produced by a smoker inhalation, determine a drive current that is used to drive the light emitting diodes, and deliver the drive current to the light emitting diodes so that the light emitted by the light emitting diodes can be gradually bright or gradually faded or flashing or intermittent.

Still another advantage of the present invention is that the thermal flow sensor based controller can be configured to: receive the output voltage representing the air flow rate from the amplifier which is produced by a smoker inhalation, calculate the amount of nicotine evaporated in each inhalation and over period time, and display the total amount of nicotine in an over period time which is inhaled by the smoker.

Still another advantage of the present invention is that the thermal flow sensor based controller can be configured to receive the output voltage representing the air flow rate from the amplifier which is produced by an accident event such as mechanical vibration or temperature changes, and determine no heating current to heat the coil heater of the atomizer since there is no real smoker inhalation to take place.

BRIEF DESCRIPTION OF THE DRAWINGS

Various features of the present invention are shown in the drawings in which like numerals indicate similar elements.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
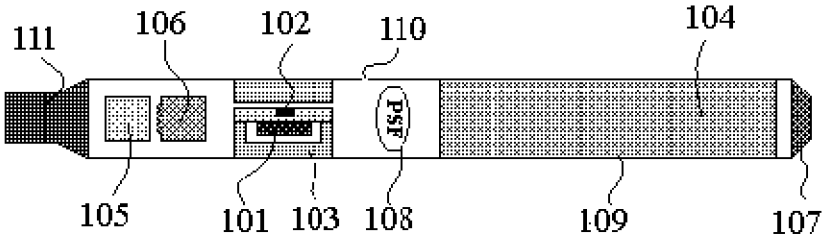
FIG. 1 is a side section view of an electronic cigarette with a thermal flow sensor based controller according to the present invention.

Referring to FIG. 1, according to the present invention, an electronic cigarette with a thermal flow sensor based controller comprising: a housing 109; a battery 104, a controller assembly 101 consisting of a thermal flow sensor 102 and an application-specific integrated circuit 103 which is disposed in the housing 109 and connected with the battery 104 and the thermal flow sensor 102 electrically; an air inlet 110 for allowing air to enter into the housing 109, and a mouthpiece 111 for allowing user to suck on the housing 109; a fluid reservoir 105; an atomizer 106 consisting of a coil heater, wherein the coil heater is arranged on the outside of an atomizer 106; at least a light emitting diode 107; and a display 108.

Figure 2:
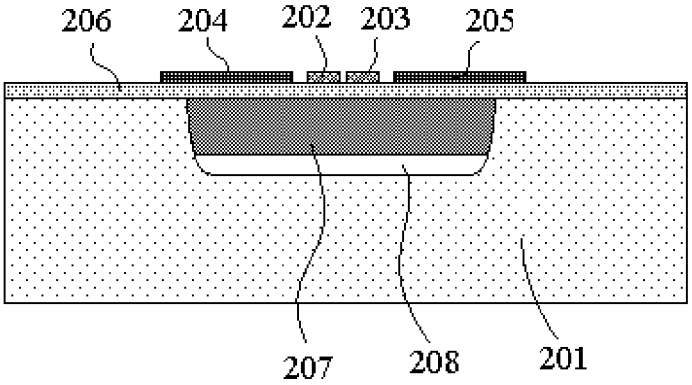
FIG. 2 is a sectional side view of a thermal flow sensor with two heaters located between two oppositely disposed thermocouples.

As shown in FIG. 2, in an embodiment, the thermal flow sensor 102 includes two parallel resistive heaters 202 and 203 and two thermopiles 204 and 205. The thermopiles 203 and 204 dispose on two opposite sides of the resistive heaters 202 and 203 respectively. The thermocouples of the two thermopiles 204 and 205 are perpendicular to the resistive heaters 202 and 203 and the hot contacts of the thermocouples of the thermopiles 204 and 205 and the resistive heaters 202 and 203 lie on a stack layer consisting of a porous silicon layer 207 and an empty gap 208. The stack layer is recessed in a silicon substrate 201 and provides local thermal isolation from the silicon substrate 201 and the cold contacts of the thermopiles of the thermopiles 203 and 204 lie on the bulk portion of the silicon substrate 201. The silicon substrate is coated with an electrical insulating layer 206 made of silicon dioxide or silicon nitride.

Figure 3:
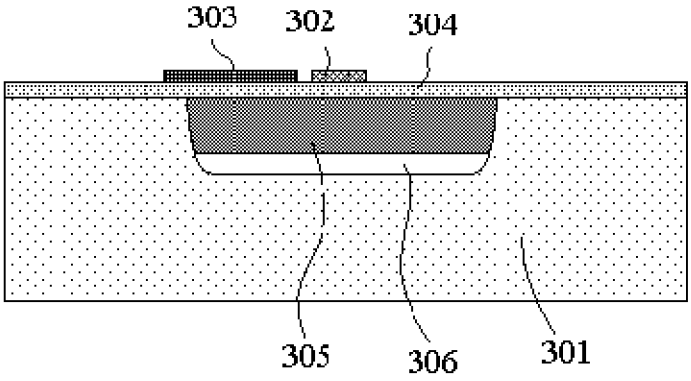
FIG. 3 is a sectional side view of a thermal flow sensor with a heater disposed parallel to a thermocouple.

As shown in FIG. 3, in another embodiment, the thermal flow sensor 102 comprises a resistive heater 302 and a thermopile 303, wherein the thermocouples of the thermopile 303 are perpendicular to the resistive heater 302. The hot contacts of the thermocouple of the thermopile 303 and the resistive heater 302 lie on a stack layer consisting of a porous silicon layer 305 and an empty gap 306. The stack layer is recessed in a silicon substrate 301 and provides local thermal isolation from the silicon substrate 301. The cold contacts of the thermocouples of the thermopile 303 lie on the bulk portion of the silicon substrate 301. The silicon substrate 301 is coated with an electrical insulating layer 304 made of silicon dioxide or silicon nitride.

The thermal flow sensor 102 is fabricated using micro-electro-mechanical systems (MEMS) technologies. MEMS technologies are derived from semiconductor IC processing such as plasma etch, thin film deposition and photolithography. MEMS devices are all around us today—from accelerometers and gyroscopes that enable today's sophisticated mobile interfaces to automobile navigation and airbag sensors, and medical and communications devices.

As well known, porous silicon layer 207 and 305 can be formed by anodization of a silicon substrate in a concentrated HF solution filed in a cell. The anodization cell usually employs platinum cathode and silicon substrate anode immersed in HF solution.

It is also well known that when the anodic current density running through the cell is very high the silicon substrate can be polished so that empty gaps 208 and 306 can be formed.

It is still also well known that porous silicon (PS) presents a thermal conductivity near to thermal conductivity of silicon dioxide. This material is an excellent candidate to ensure the thermal insulation for the micro sensors on silicon because it ensures the mechanical stability of the microstructure. For this reason, PS layers have been effectively used as material for local thermal isolation on bulk silicon and as material for the fabrication of micro-hotplates for low- power thermal sensors.

Preferably, the stack layer of porous silicon layer and empty gap has an area ranging from 0.2 to 1.0 square millimeter. The thickness of the porous silicon layer 207 and 305 ranges from 10 to 50 microns. The thickness of the empty gap 208 and 306 ranges from 2 to 10 microns. The chip area of the thermal flow sensor ranges from 2 to 4 square millimeter. Still preferably, the resistive heaters 202, 203 and 302 are made of polysilicon and the thermopiles 204, 205 and 303, each of which consists of 10 to 30 thermocouples, are made of n-type and p-type polysilicon or p-type polysilicon and aluminum.

It should be appreciated from the above that MEMS technology is amenable to create the thermal flow sensors having micro-heaters and integrated thermopiles with no moving parts, thus simplifying fabrication and operational requirements. Other advantages of thermal flow sensors are small size, short response time, low power consumption, higher sensitivity to low flow rates.

It should be understood that the thermal flow sensor 102 is installed in the housing 108 with its longitudinal direction perpendicular to the resistive heater(s) so that when there is no air flow through the housing 108, the temperature profile around the resistive heater(s) is symmetric and when an air flow is produced by a smoker inhalation, the temperature profile will shift from the up flow direction to the down flow direction, which represents the temperature change caused by the air flow and can be detected by the thermopile(s) of the sensor so that an electrical signal is generated which represents the rate of the air flow.

It should be noted that the thermal flow sensor 102 has several significant advantages. The first is that the thermal 102 can be operated by pulse heating mode, in which the width of heating pulses can be as short as 5 ms so that power consumption of the thermal flow sensor can be as low as in the range of 0.01 to 10 mw. The second is that the thermal flow sensor 102 has very high dynamic range and can measure air flow rate from 0.01 to 100 liter. The third is that the thermal flow sensor 102 has very fast response time which is as low as 5 ms.

More advantage is that the heaters 302 of the thermal flow sensor can be driven by the modulated voltage pulses so that the static (no air flow) output voltage of the thermopile 303 can be stabilized at a fixed value so that its amplified can have null offset.

Still more advantage is that the heater 202 and 203 of the thermal flow sensor can be respectively driven by two modulated power sources so that the static output voltage (no air flow) of the thermopiles 204 and 205 becomes zero.

It is accepted that the housing 108 is a tube having a diameter less than 15 mm and the air flow rate caused by an inhalation is less than 3 SLPM. It can be calculated that the type of the air flow in the tube is limited to be laminar flow since the Reynolds number Red is less than 2300 (As well known that For air flow in a tube, experimental observations show that laminar flow occurs when Red<2300 and turbulent flow occurs when Red<4000).

It is appreciated from the above that the airway for the air flow passing which is caused by a smoker inhalation can be configured to have a flow resistance to the air flow without any restriction.

Figure 4:
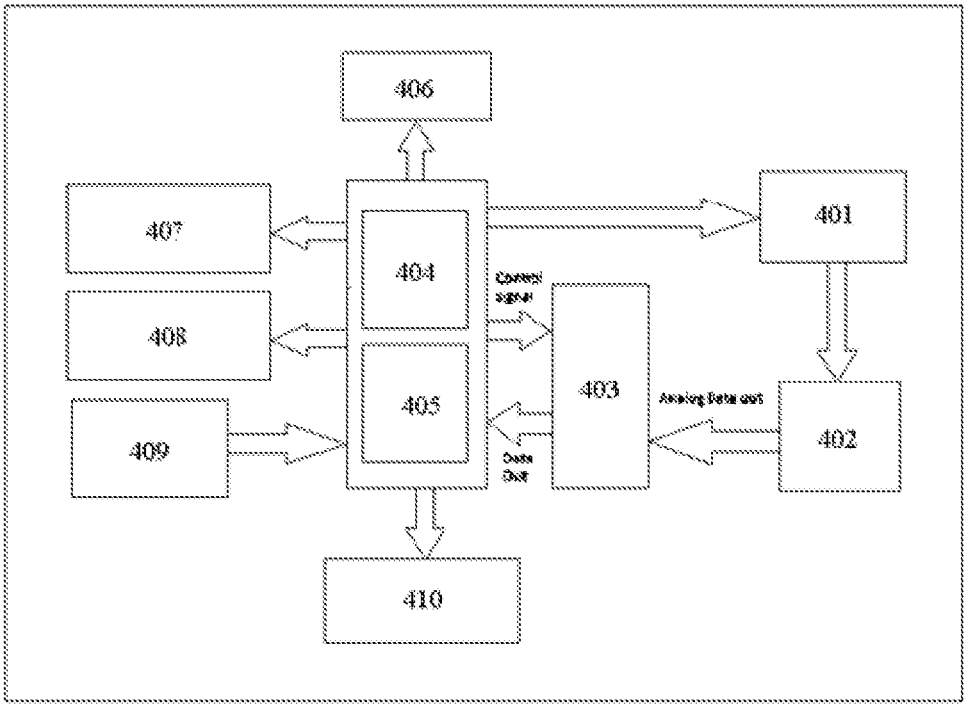
FIG. 4 is a schematic block-diagram of a preferred controller with a thermal flow sensor therein.

Reference to FIG.4, the controller 101 is an application-specific integrated circuit, or ASIC which contains a thermal flow sensor 401, an amplifier 402, an analog-to-digital converter (ADC) and a digital-to-analog converter (DAC) 403, a processor core 404, a memory 405, a power supply 406, an interface to atomizer 407, an interface to light emitting diodes 408, a code input 409, and an interface to display 410.

It should be noted that the ASIC is configured to receive the output voltage representing the air flow rate detected by the thermal flow sensor 401 from the amplifier 402 which is caused by a smoker inhalation, determine a heating current that is used to heat the coil heater of the atomizer 407, and deliver an amount of the fluid vapor to the smoker which is wanted by the smoker regardless of a hard inhalation or a weak inhalation and a longer inhalation or a short inhalation.

It still should be noted that the ASIC is further configured to receive the output voltage representing the air flow rate detected by the thermal flow sensor 401 from the amplifier 402 which is caused by an accidental event such as mechanical vibration and temperature change, identify that the output voltage is not caused by a smoker inhalation.

It still should be noted that the ASIC is still further configured to receive the output voltage representing the air flow rate detected by the thermal flow sensor 401 from the amplifier 402, determine a drive current that is used to drive the light emitting diodes 408, and deliver the drive current to the light emitting diodes 408 so that the light emitted by the light emitting diodes 408 can simulate the light emitted by a lighted real tobacco cigarette with a gradually bright or gradually fade.

It still should be noted that the ASIC is still further configured to receive the output voltage representing the air flow rate detected by the thermal flow sensor 401 from the amplifier 402, calculate the amount of nicotine of each puff and the integrated amount over a period of time which is inhaled by a smoker, and enable the display to display the amount of nicotine of each puff and the integrated amount over a period of time which is inhaled by a smoker.

Figure 5:
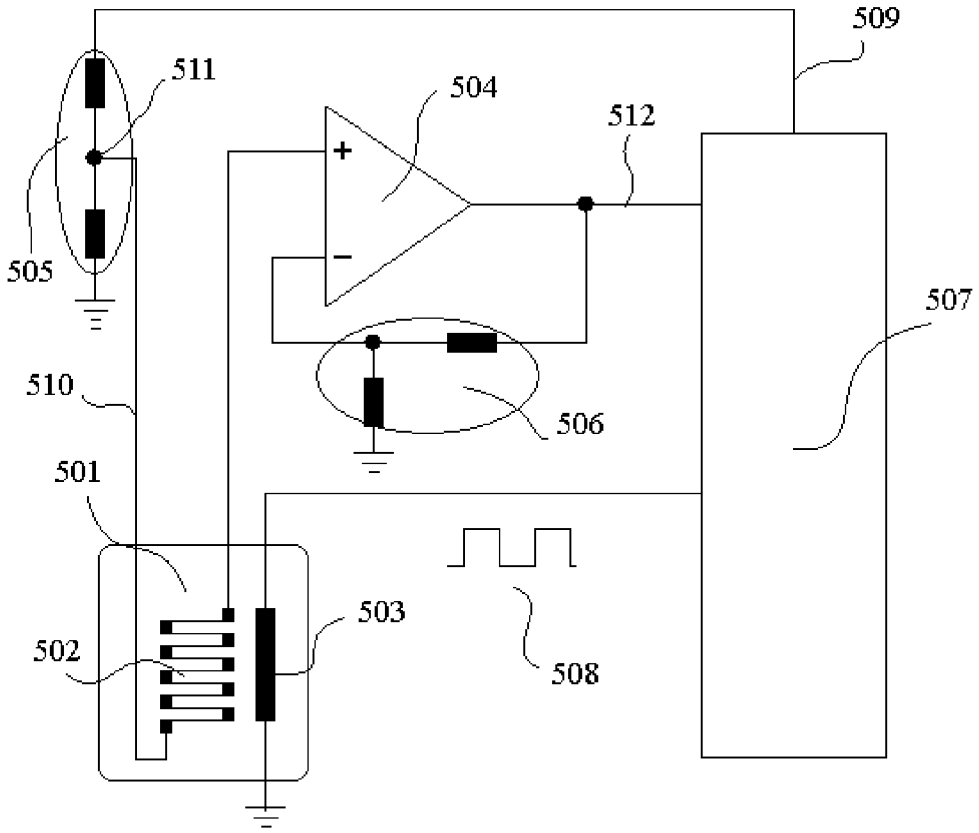
FIG. 5 is a schematic block-diagram of a preferred voltage modulation circuit for a thermal flow sensor with a heater arranged parallel to a thermocouple.

As shown in FIG. 5, a voltage modulation circuit of the thermal flow sensor with a resistive heater and a thermopile thereof comprises a thermal flow sensor 501 consisting of a resistive heater 503, a thermopile 502, an amplifier 504, a reference voltage divider 505, two amplifier gain adjusting resistors 506, a voltage modulation circuit 507, a modulated rectangular voltage pulses 508, a reference voltage 509, a divided reference voltage 510, a thermal flow sensor output voltage 511, and an amplifier output voltage 512.

In operation of the above voltage modulation circuit without an air flow over the thermal flow sensor 501, the resistive heater 503 is heated by the rectangular pulse voltage 508 provided by the voltage modulation circuit 507 and the thermopile 502 produces a static (no air flow) output voltage 511. The voltage modulation circuit 507 also provides a reference voltage 509 which is divided by the reference voltage adjusting resistors 505 and produces a divided reference voltage 511. The differential voltage of the thermal flow sensor output voltage 510 and the divided reference voltage 511 is amplified by the amplifier 504 in which the gain is adjusted by the gain adjusting resistors 506. The output voltage 512 of the amplifier 504 is sent to the voltage modulation circuit 507 and the voltage modulation circuit 507 determines whether the modulated rectangular pulse voltage 508 is modulated again. If the output voltage 512 of the amplifier 504 is not zero the rectangular pulse voltage 508 needs to be modulated until the output voltage 512 of the amplifier 504 equals to zero. In this way the offset of both the thermal flow sensor 501 and the amplifier 504 can be constantly maintained zero.

Figure 6:
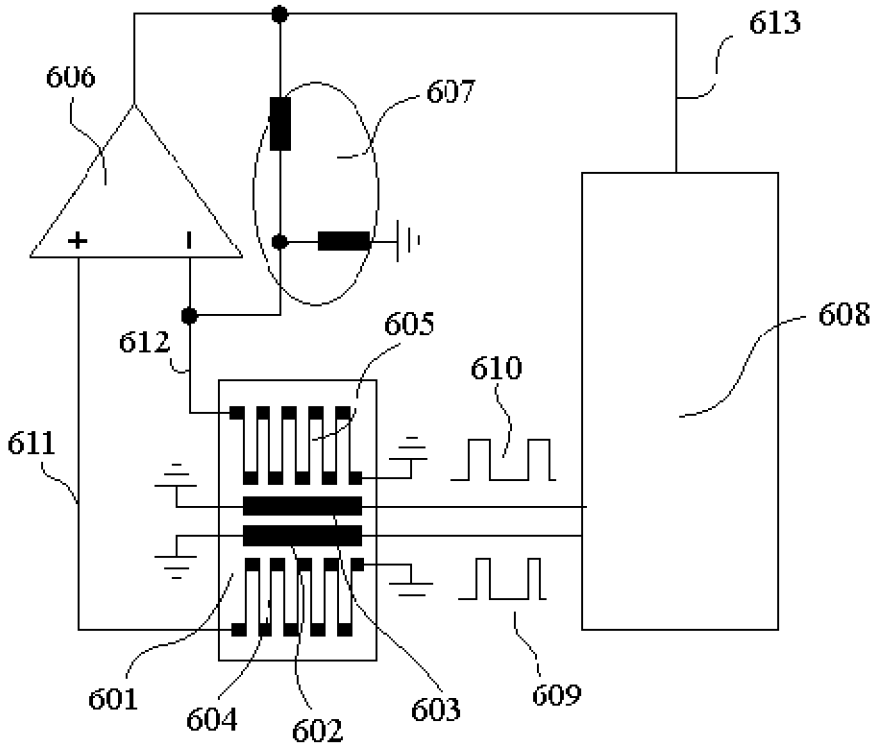
FIG. 6 is a schematic block-diagram of a preferred voltage modulation circuit for a thermal flow sensor with two heaters located between two oppositely disposed thermocouples.

As shown in FIG. 6, a voltage modulation circuit of the thermal flow sensor with two resistive heater and two thermopile thereof comprises a thermal flow sensor 601 consisting of resistive heaters 602 and 603, two thermopile 604 and 605, an amplifier 606, two amplifier gain adjusting resistors 607, a voltage modulation circuit 608, two modulated rectangular voltage pulses 609 and 610, the output voltage 611 of the thermopile 604, the output voltage 612 of the thermopile 605, and an output voltage 613 of the thermopile 605.

In operation of the above voltage modulation circuit without an air flow over the thermal flow sensor 601, the resistive heaters 602 and 603 are heated respectively by the modulated rectangular pulse voltages 609 and 610 provided by the voltage modulation circuit 608 and the thermopiles 609 and 610 produce respectively a static (no air flow) output voltage 611 and a static (no air flow) output voltage 612. The differential voltages of the output voltage 609 and 610 is amplified by the amplifier 606 in which the gain is adjusted by the gain adjusting resistors 607. The output voltage 613 of the amplifier 606 is sent to the voltage modulation circuit 608 and the voltage modulation circuit 608 determines whether the modulated rectangular voltage pulses 609 and 610 are modulated again. If the output voltage 613 of the amplifier 606 is not zero the modulated rectangular voltage pulses 609 and 610 need to be modulated until the output voltage 613 of the amplifier 606 equals to zero. In this way the offsets of both the thermal flow sensor 601 and the amplifier 606 can be constantly maintained zero.

Both the voltage modulation circuits 507 and 608 are application-specific integrated circuits and can be combined with the ASIC of FIG. 4.

Voltage modulation can be realized by a pulse-width modulator (PWM) which is a simplest digital-to-analog converter (DAC). In this DAC type a stable voltage is switched into a low-pass analog filter with a duration determined by the digital input codes converted by the output voltages 512 and 613 of the amplifiers 505 and 606.

Voltage modulation also can be realized by a switched resistor DAC which contains of a parallel resistor network. Individual resistors are enabled or bypassed in the network based on the digital codes converted by the output voltages 512 and 613 of the amplifiers 505 and 606.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

What is claimed is:

1. An electronic cigarette with a thermal flow sensor based controller comprising: a housing; a battery; a controller assembly consisting of a thermal flow sensor and an application-specific integrated circuit (ASIC) which is disposed in the housing and connected with the battery and the thermal flow sensor electrically; an air inlet for allowing air to enter into the housing; a mouthpiece for allowing user to suck on the housing; a fluid reservoir; an atomizer and a coil heater, wherein the coil heater is arranged on at least a portion of outer surface of the atomizer; at least a light emitting diode; and a display, wherein the thermal flow sensor includes: two parallel resistive heaters and two thermopiles, wherein the thermopiles dispose on two opposite sides of the resistive heaters respectively, wherein each of the thermopiles includes a plurality of thermocouples wherein orientation of the thermocouples is substantially perpendicular to orientation of the resistive heater, and the thermopiles and the resistive heaters lie on a stack layer consisting of a porous silicon layer and an empty gap, which are recessed in a silicon substrate and provide local thermal isolation from the silicon substrate, and the cold contacts of the thermopiles lie on the bulk portion of the silicon substrate.

2. The electronic cigarette of claim 1, wherein the two parallel resistive heaters of the thermal flow sensor can be driven by a series of modulated voltage pulses.

3. The electronic cigarette of claim 2, further comprising modulated voltage pulses generated by a voltage-controlled pulse width modulator (PWM).

4. The electronic cigarette of claim 2, further comprising modulated voltage pulses generated by a switched resistor digital-to-analog converter (DAC).

5. The electronic cigarette of claim 1, wherein the thermal flow sensors are configured to operate in pulse heating mode, in which a width of heating pulses is approximately 5 milliseconds (ms) so that power consumption of the thermal flow sensor is in the range of 0.01 to 10 milliwatts (mw) in which the low power consumption is utilized during a sleep mode and higher power consumption is activated in normal working mode.

6. The electronic cigarette of claim 1, wherein the thermal flow sensor has a high dynamic range and can measure an air flow rate from 0.01 to 100 liter per minute.

7. The electronic cigarette of claim 1, wherein the thermal flow sensor is installed in the housing and a temperature profile around the resistive heaters is configured to shift to a flow direction which represents temperature change caused by an air flow and detected by the thermopiles of the sensor.

8. The electronic cigarette of claim 7, wherein the air flow rate detection is operated by the thermal flow sensor based controller, in which a response time to a smoker inhalation can be approximately 5 milliseconds (ms).

9. The electronic cigarette of claim 1, wherein the housing is a tube having a diameter less than 15 mm, wherein the thermal flow sensor senses an air flow rate less than 3 standard liters per minute (SLPM) such that the type of the air flow in the tube is limited to be laminar flow.

10. The electronic cigarette of claim 1, wherein the thermal flow sensor is installed in an airway disposed in the housing which provides an air flow caused by a smoker inhalation which imitates a real tobacco cigarette.

11. An electronic cigarette with a thermal flow sensor based controller comprising: a housing; a battery; a controller assembly consisting of a thermal flow sensor and an application-specific integrated circuit (ASIC) which is disposed in the housing and connected with the battery and the thermal flow sensor electrically; an air inlet for allowing air to enter into the housing; a mouthpiece for allowing user to suck on the housing; a fluid reservoir; an atomizer and a coil heater, wherein the coil heater is arranged on at least a portion of outer surface of the atomizer; at least a light emitting diode; and a display, wherein the thermal flow sensor includes: two parallel resistive heaters and two thermopiles, wherein the thermopiles dispose on two opposite sides of the resistive heaters respectively, wherein the resistive heaters and hot contacts of the thermopiles are situated on a stack layer consisting of a porous silicon layer and an empty gap, which are recessed in a silicon substrate and provide local thermal isolation.

12. The electronic cigarette of claim 11, wherein the heaters of the thermal flow sensor can be driven respectively by a series of modulated voltage pulses which is modulated by the static (no air flow) output voltage of the thermopiles so that an offset voltage of the thermopiles remains approximately zero.

13. The electronic cigarette of claim 11, wherein the thermal flow sensors are configured to operate in pulse heating mode, in which a width of heating pulses is approximately 5 milliseconds (ms) so that power consumption of the thermal flow sensor is in the range of 0.01 to 10 milliwatts (mw) in which the low power consumption is utilized during a sleep mode and higher power consumption is activated in normal working mode.

14. The electronic cigarette of claim 11, wherein the thermal flow sensor has a high dynamic range and can measure an air flow rate from 0.01 to 100 liter per minute.

15. The electronic cigarette of claim 11, wherein the thermal flow sensor is installed in the housing and a temperature profile around the resistive heaters is configured to shift to a flow direction which represents temperature change caused by an air flow and detected by the thermopiles of the sensor.

16. The electronic cigarette of claim 15, wherein the air flow rate detection is operated by the thermal flow sensor based controller, in which a response time to a smoker inhalation can be approximately 5 milliseconds (ms).

17. An electronic cigarette with a thermal flow sensor based controller comprising: a housing; a battery; a controller assembly consisting of a thermal flow sensor and an application-specific integrated circuit (ASIC) which is disposed in the housing and connected with the battery and the thermal flow sensor electrically; an air inlet for allowing air to enter into the housing; a mouthpiece for allowing user to suck on the housing; a fluid reservoir; an atomizer and a coil heater, wherein the coil heater is arranged on at least a portion of outer surface of the atomizer; at least a light emitting diode; and a display, wherein the application-specific integrated circuit or ASIC contains an amplifier, a processor core, an analog-to-digital converter or ADC, a digital-to-analog converter or DAC, memory, an interface to atomizer, an interface to light emitting diodes, interface to display, code input, and a power supply, wherein the ASIC is configured to: receive an output voltage from the battery wherein the output voltage is controlled in accordance with an air flow rate which is produced by a smoker inhalation; determine a heating current that is used to heat the coil heater of the atomizer; and deliver an amount of fluid vapor to the smoker regardless of hard inhalation or weak inhalation and longer inhalation or shorter inhalation.

18. The electronic cigarette of claim 17, wherein the ASIC is configured to: identify mechanical vibration; and suspend heating current that is used to heat the coil heater of the atomizer and suspend delivery of fluid vapor.

19. The electronic cigarette of claim 17, wherein the ASIC is further configured to: receive the output voltage representing the air flow rate; determine a drive current that is used to drive the light emitting diode; and deliver the drive current to the light emitting diodes such that the light emitted by the light emitting diodes can be gradually bright or gradually faded or flashing or intermittent.

20. The electronic cigarette of claim 17, wherein the ASIC is still further configured to: receive the output voltage representing the air flow rate; calculate a duration and an inhaled nicotine amount of each puff and a total inhaled nicotine amount over a period of time; and enable the display to display the duration and the inhaled nicotine amount of each puff and a number of puffs and a total inhaled nicotine amount over a period of time.

* * * * *